United States Patent [19]

Aloi et al.

[11] Patent Number: 4,876,940

[45] Date of Patent: Oct. 31, 1989

[54] MAGAZINE AMMUNITION CONVEYING SYSTEM

[75] Inventors: Anthony J. Aloi, Richmond; Robert R. Bernard, Essex Jct.; Edward A. Proulx, Burlington, all of Vt.

[73] Assignee: General Electric Company, Burlington, Vt.

[21] Appl. No.: 181,756

[22] Filed: Apr. 14, 1988

[51] Int. Cl.[4] ..... F41D 10/14; B65G 29/00

[52] U.S. Cl. ..... 89/33.16; 89/34; 198/803.13

[58] Field of Search ..... 89/33.16, 33.25, 34; 198/484.1, 803.13

[56] References Cited

U.S. PATENT DOCUMENTS

| | | | |
|---|---|---|---|
| 2,149,561 | 3/1939 | Thompson | 198/803.13 |
| 3,101,647 | 4/1952 | Greene | 89/46 |
| 3,135,787 | 4/1957 | Van Der Winden | 198/803.13 |
| 3,169,445 | 6/1957 | Stanton et al. | 89/33.16 |
| 3,186,303 | 6/1963 | Linke et al. | 89/1.7 |
| 3,418,918 | 12/1968 | Beauvais et al. | 99/362 |
| 3,434,582 | 3/1969 | Reimers | 198/484.1 |
| 3,434,585 | 3/1969 | Lee | 198/484.1 |
| 3,670,863 | 6/1972 | Meier et al. | 198/803.13 |
| 3,724,644 | 4/1973 | Reimers | 198/803.13 |
| 4,573,395 | 3/1986 | Stoner | 89/33.16 |
| 4,619,181 | 10/1986 | Pehker et al. | 89/34 |

*Primary Examiner*—Charles T. Jordan
*Assistant Examiner*—Michael J. Carone
*Attorney, Agent, or Firm*—Bailin L. Kuch; Robert A. Cahill

[57] ABSTRACT

An ammunition feeding system includes an endless, ladder-type conveyor trained throughout the interior of a magazine in a serpentine formation consisting of a plurality of straight line sections and interconnecting turnaround sections. The conveyor includes a succession of carriers which are adapted to assume a closed, ammunition round retention condition while in the straight line sections and to automatically open while in the turnaround sections to effect round handoffs to any transfer station located thereat for live round-spent round exchanges with respect to the carriers as they transit the turnaround section. Guides are positioned at the other turnaround sections to preclude round handoffs by the opened carriers.

16 Claims, 4 Drawing Sheets

MAGAZINE AMMUNITION CONVEYING SYSTEM

The present invention relates to a system for conveying articles, and particularly to a system for conveying linkless ammunition rounds from storage within a magazine to a transfer port for handoff to a rapid-fire machine gun or cannon.

BACKGROUND OF THE INVENTION

In a typical linear linkless ammunition feeding system, the individual rounds of ammunition are accommodated in separate carriers which are serially interconnected to provide a ladder-type conveyor. This conveyor is circuitously trained throughout the interior of the magazine in a manner to maximize packing or storage density and delivers the ammunition rounds to a transfer point where they are handed off seriatim to a gun for firing. In many gun system applications, it is required that the spent shell cases be saved rather than simply ejected from the system. In such case, the magazine conveyor is typically made endless, and the spent shell cases are successively returned to the transfer point and deposited in the just emptied carriers for storage in the magazine.

An ammunition conveyor fully loaded with live rounds has a rather heavy cargo to contend with. In modern gun systems, the magazine conveyor is called upon to accelerate from a standing start to a gun firing rate of several thousands of rounds per minute in less than a second. This requires a significant power source for the conveyor. To minimize the conveyor power requirements, the conveyor must itself be as light in weight a possible, while maintaining positive control of the individual ammunition rounds in the face of such extreme acceleration forces. When the gun system is mounted on fighter aircraft, the inertial forces incident to aircraft maneuvers must also be taken into account to assure that the ammunition rounds do not become dislodged from their carriers and thereby jam the magazine conveyor. Heretofore, ammunition conveyor systems have typically utilized an array of guide plates and/or separator plates arrayed throughout the conveyor path within the magazine to serve in cooperation with the round carriers to maintain positive control of the individual ammunition rounds. These round-engaging plates impose a frictional drag on round conveyance which must be overcome by the conveyor power source. The additional weight and space represented by these round control plates and the requisite larger power source are definite liabilities particularly in airborne applications, where weight and space limitations are critical. The alternative is to reduce the magazine ammunition capacity, which is certainly not a desirable and often times even an acceptable approach.

Another important consideration is the reliable handoffs of live ammunition rounds and spent shell cases to and from the magazine conveyor. These handoffs occur at several transfer ports in the magazine. One such transfer port is at the interface of the magazine conveyor with a gun feeding conveyor where live ammunition rounds are handed off from the individual magazine conveyor carriers in subsequent exchange for spent shell cases. These handoffs back and forth occur at the gun firing rate and require that the conveyor carrier relinquish positive control of the live rounds to accommodate handoff to the gun conveyor and assume positive control of the spent cases handed back from the gun conveyor, all in a split seconds time. The other transfer port is at the interface with ammunition loading equipment where the magazine conveyor hands off spent cases in exchange for live rounds. This magazine loading operation is typically performed at a rate significantly less than gun firing rate, but nevertheless requires that the magazine conveyor carriers relinquish spent case control for handoff and acquire live round control upon handback in a rapid and reliable manner. It is obviously important that the additional elements required to effect these live round—spent case exchanges with the magazine conveyor be efficiently structured in size, weight and operation in order to meet the rigorous demands of modern rapid-fire gun systems.

It is accordingly an object of the present invention to provide an improved linear linkless ammunition conveying system.

An additional object is to provide an ammunition conveying system of the above-character which includes a conveyor having a series of improved carriers adapted to maintain positive control over the individual ammunition rounds during conveyance.

Another object is to provide an ammunition conveying system of the above-character, wherein the individual conveyor ammunition round carriers are of a lightweight, yet structurally rigid construction.

A further object is to provide an ammunition conveying system of the above-character, wherein ammunition round conveyance is achieved with minimal frictional drag.

Still another object is to provide an ammunition conveying system of the above-character, wherein efficiency is maximized and thus power consumption is minimized.

An additional object is to provide an ammunition conveying system of the above-character, wherein the handoffs of live rounds and spent cases between the ammunition conveyor and interfacing equipment are effected in an efficient and reliable fashion.

A further object is to provide an ammunition conveying system for conveying rounds throughout the interior of an ammunition storage container or magazine in a manner such as to maximize storage or packing density.

Other objects of the invention will in part be obvious and in part appear hereinafter.

SUMMARY OF THE INVENTION

In accordance with the present invention, there is provided an ammunition storage container or magazine in which is accommodated an endless ladder-type ammunition conveyor arranged in a serpentine formation consisting of a plurality of straight line path sections and interconnecting, tightly folded turnaround path sections, the latter being trained around a series of appropriately spaced turnaround sprockets. The conveyor includes a succession of closely spaced ammunition round carriers. Each such carrier comprises a pair of opposed, pivotally interconnected carrier halves adapted (i) to automatically assume closed, ammunition round retentive relative positions while disposed in the straight line conveyor path sections and (ii) to automatically assume opened, ammunition round releasing relative positions while in the conveyor turnaround path sections.

One of the conveyor turnaround sections is located at a magazine transfer port where ammunition rounds are to be handed off from the opened, arriving carriers to interfacing equipment such as a gun conveyor operating to successively feed handed off live rounds to a gun for firing and typically to successively feed spent cases back to the transfer port for handoff back to the just emptied carriers prior to their departure from the turnaround section. To handle this live round-spent case exchange in accordance with the present invention, there is provided a transfer station including (i) a driven, accelerating sprocket operating to engage and accelerate each released live round from conveyor velocity to a transfer velocity, (ii) a driven, transfer sprocket accepting accelerated live rounds from the accelerating sprocket for handoff to the interfacing equipment and for accepting in return the handoff of spent cases, and (iii) a driven decelerating sprocket for decelerating spent cases back to conveyor velocity and depositing them in the opened carriers. A second, identical transfer station is located at another magazine transfer port which can be interfaced with ammunition loading equipment operating to deposit live rounds into opened carriers in exchange for spent cases as the carriers negotiate a turnaround section located thereat. Stationary guides are positioned to preclude the release of ammunition rounds from the carrier as they transit the other turnaround sections of the conveyor serpentine formation.

Since the closed carriers effectively cradle the ammunition rounds during transit of the straight line sections, guides and separator plates are unnecessary to assure positive control over the individual rounds. Conveyor guidance and control along these straight-line sections are provided by opposed, enlarged rollers received in magazine-mounted trackways. Conveyor movement throughout the magazine interior is thus achieved with minimal frictional drag, and minimized power is therefore required to accelerate the conveyor to a rapid gun firing rate.

The invention accordingly comprises the features of construction, combination of elements and arrangement of parts, all of which will be exemplified in the construction hereinafter set forth, and the scope of the invention will be indicated in the claims.

BRIEF DESCRIPTION OF THE DRAWINGS

For a better understanding of the nature and objects of the invention, reference may be had to the following detailed description taken in connection with the accompanying drawings, in which.

Corresponding reference numerals refer to like parts throughout the several views of the drawings.

DETAILED DESCRIPTION

Figure 1:
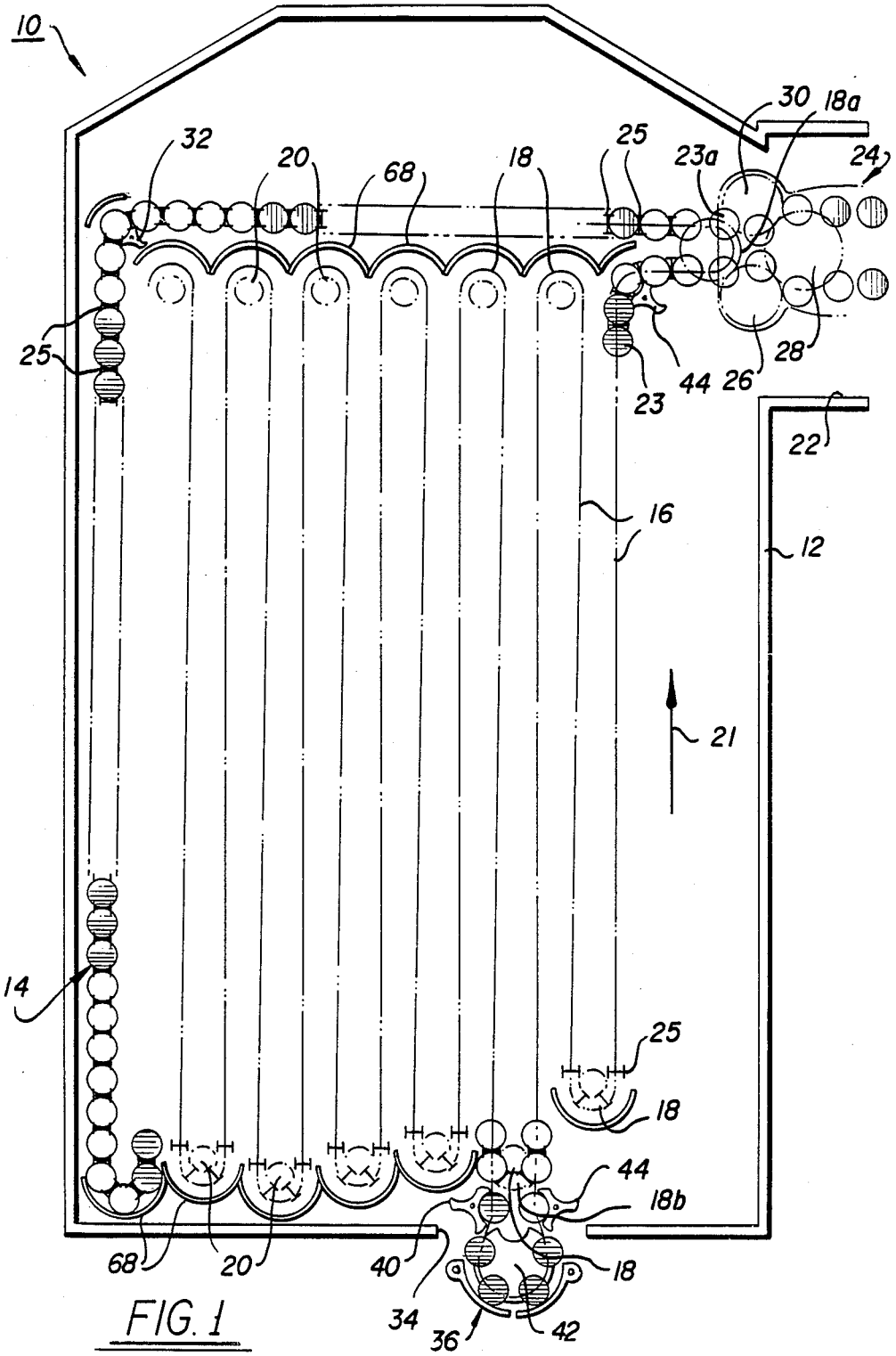
FIG. 1 is a side elevational view, partially in diagrammatic form, of a magazine ammunition conveying system constructed in accordance with the present invention.

Referring to FIG. 1, the ammunition conveying system of the present invention, generally indicated at 10, includes an ammunition storage container or magazine 12 containing an endless, ladder-type conveyor, generally indicated at 14, arranged in a serpentine formation consisting of a plurality of straight line path sections 16 and interconnecting turnaround path sections 18; the latter sections being trained around a series of upper and lower turnaround sprockets 20 in tightly folded, 180° turns. Conveyor 14 is driven in the direction of arrow 21 by applying power to at least some of the turnaround sprockets to convey live ammunition rounds 23 to a turnaround conveyor section **18*a* located at a magazine transfer port 22 where a transfer station, generally indicated at 24, is also located. This transfer station operates in conjunction with individual conveyor ammunition round carriers 25 in the manner described below to effect the successive handoffs of line rounds to a suitable gun feeding conveyor (not shown) which is interfaced with magazine port 22 and to accept in exchange the handbacks of spent rounds or cases 23*a* for storage on conveyor 14. To accomplish these live round-spent case exchanges, transfer station 24 is equipped with a driven, live round engaging sprocket 26 operating to accelerate each live round as it is handed off by its conveyor carrier 25 upon entry into turnaround section 18*a* from conveyor velocity to a suitable transfer velocity. From this accelerating sprocket, the live rounds 23 are handed off to a driven transfer sprocket 28 for hand off to the gun feeding conveyor. This transfer sprocket also accepts handoffs of spent cases 23*a* from the gun conveyor for handoff to a driven, spent round engaging sprocket 30 operating to decelerate the spent cases to conveyor velocity and to successively hand them off to the just emptied conveyor carriers prior to their departure from the turnaround section 18*a***.

From transfer port 22, conveyor 14 moves across the top of magazine 12, through a 90° turn around a sprocket 32, and down into its serpentine path of up and down straight line sections 16 and interconnecting turnaround sections 18. One of these turnaround sections, indicated at **18*b*, is presented at a second magazine transfer port 34 where a transfer station, generally indicated at 36, is located. This transfer station is basically identical to transfer station 24 and operates to effect live round-spent case exchanges with ammunition loading equipment (a portion shown at 72 in FIG. 6) interfaced with magazine port 34. That is, when the aircraft bearing the rapid-fire gun system returns to its base, the spent cases stored in magazine 12 on conveyor 14 must be exchanged for live ammunition rounds. To this end, the ammunition loading equipment is interfaced with magazine port 34, and spent cases are handed off by the conveyor carriers 25 to transfer station 36 upon arrival at turnaround section 18*b*. The transfer station then successively hands off the spent cases to the loading equipment and, in exchange, accepts successive live rounds from the loading equipment for deposit into the conveyor carriers prior to their departure from turnaround section 18*b*. Thus, like transfer station 24, transfer station 36 includes an accelerating sprocket 40 for accelerating the spent cases handed off by the conveyor carriers to a suitable transfer velocity, a transfer sprocket 42 for transferring spent cases from sprocket 40 to the loading equipment, and a decelerating sprocket 44 for decelerating live rounds transferred thereto from the loading equipment via transfer sprocket 42 down to conveyor velocity and depositing the decelerated live rounds into the conveyor carriers before they complete their transit of turnaround section 18***b*. This operation of transfer station 36 will be described in greater detail below in conjunction with FIGS. 5 and 6.

From magazine transfer port 34, the conveyor progresses along several more straight line and turnaround sections and through a 90° turnaround sprocket 45 to turnaround section 18*a* at magazine transfer port 22, thus completing its endless loop path throughout the interior of magazine 12.

Figure 2:
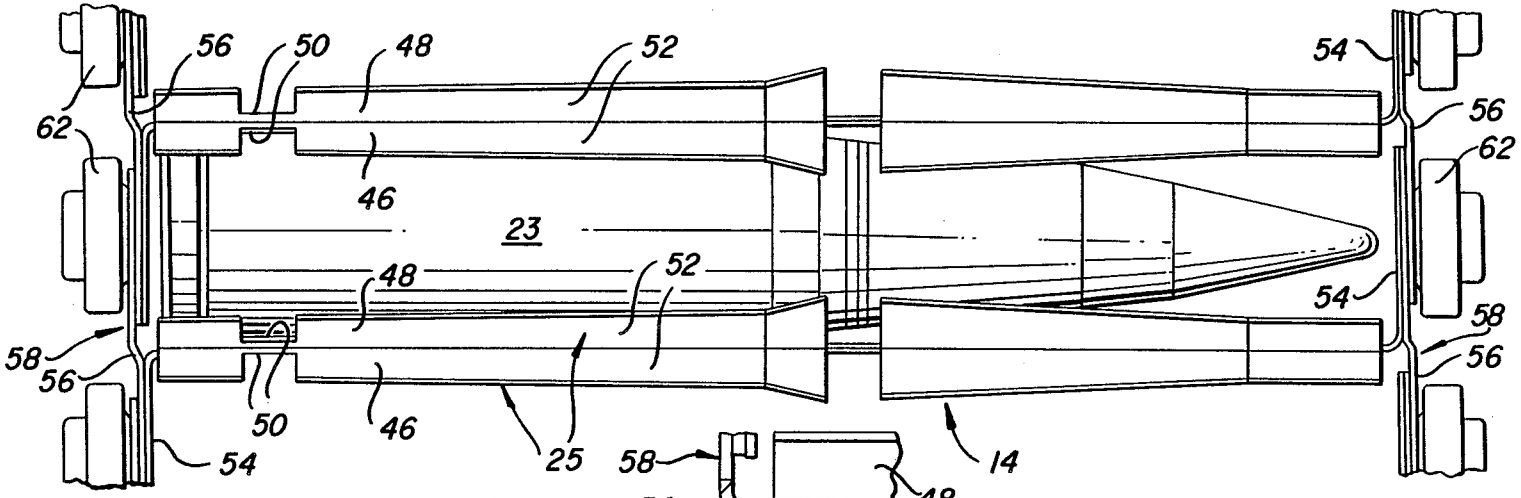
FIG. 2 is an enlarged, fragmentary plan view of the ammunition conveyor utilized in the magazine ammunition conveying system of FIG. 1.
Figure 3:
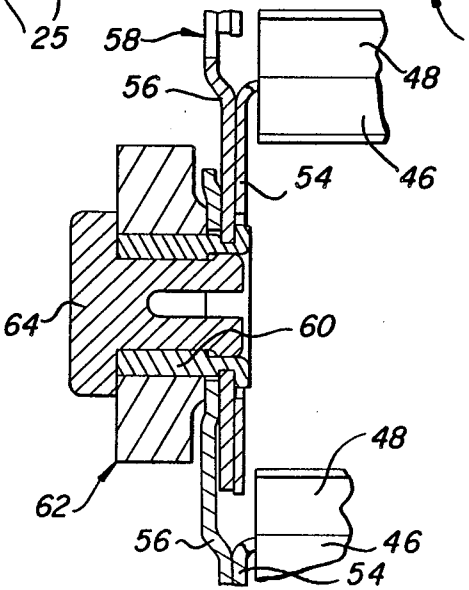
FIG. 3 is an enlarged, sectional view of the right end portion of the conveyor seen in FIG. 2.
Figure 4:
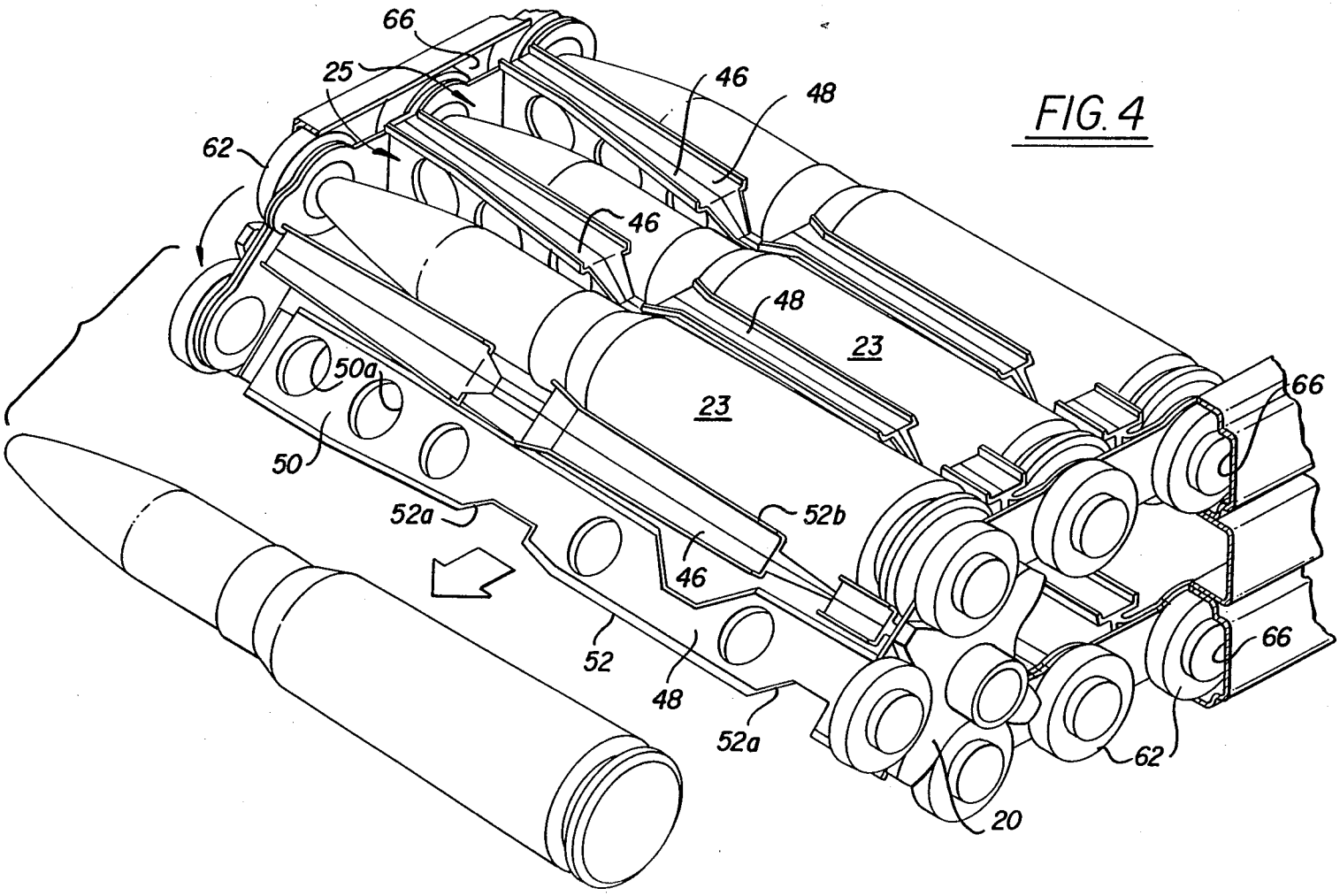
FIG. 4 is an enlarged perspective view of the ammunition conveyor of FIG. 1 illustrating the opening of the individual conveyor ammunition round carriers during negotiation of the turnaround sections of the conveyor serpentine path within the magazine.

Referring jointly to FIGS. 2 through 4, ammunition conveyor 14 includes an endless succession of ammunition round carriers, generally indicated at 25, which are in the form of pivotally interconnected carrier halves 46 and 48 structured to assume closed, round cradling relative positions while in the straight line conveyor sections 16 (FIG. 1) and to automatically assume opened, round releasing relative positions while in the turnaround conveyor sections 18. The preferably symmetrical carrier halves are integrally formed of sheet metal having a planar midsection 50 and opposed upstanding sides 52. The midsections 50 of halves 46 and 48 of adjacent carriers 25 are affixed in juxtaposed, back-to-back relation by suitable means, such as spot welds, thereby reducing inter-carrier spacing to a minimum and enhancing the structural rigidity of the carrier halves. As seen in FIGS. 2 and 3, tabs 54 extending from opposite ends of each united pair of carrier halves 46, 48 are affixed to separate links 56 of opposed conveyor chains, generally indicated at 58. The consecutive links of each conveyor chain are pivotally interconnected by cylindrical pins 60, each of which also serving to rotaably mount a roller 62. A retainer 64 is snap-fitted into each pin bore to maintain rollers 62 in place. These rollers are engaged by the set of opposed turnaround sprockets 20 pursuant to training the conveyor chains 58 through each turnaround section 18 in a tightly folded 180° turn. Moreover, as seen in FIG. 4, these rollers 62 ride in opposed, magazine mounted trackways 66 oriented along the straight line conveyor sections to provide control and guidance of ammunition round carrier movement therethrough.

It is thus seen that the halves 46 and 48 of each carrier 25 are pivotally interconnected at their opposite ends by adjacent links 56 of the opposed conveyor chains 58. While the carriers occupy the straight line sections of the ammunition conveyor path, the height of the carrier half sides 52 are made sufficient to effectively cradle in clamshell fashion a live ammunition round 23 or a spent case 23*a*. That is, the gaps between the upstanding sides 52 of the opposed carrier halves 46 and 48 are smaller than the case diameter, and thus positive round retention by each carrier is assured while in a straight line section of the conveyor path.

However, when the carriers 25 arrive at each turnaround section 18 to execute the tight 180° turn about the set of opposed turnaround sprockets 20 thereat, the halves 46, 48 of each carrier pivot relative to each other on their interconnecting chain links 56 such that the gap between the carrier half sides 52 on the outboard side of the turnaround section increases to a dimension greater than the round diameter. The carrier halves thus, in effect, assume opened relative positions as their carrier 25 transits the turnaround sections, and the released ammunition round is propelled away from its carrier by both its own centrifugal force and the push provided by the trailing carrier half 46, as seen in FIG. 4. The carriers thus effectively act in the manner of handoff sprockets in transferring rounds to the transfer stations 24 and 36 upon entry into the turnaround sections 18*a* and 18*b*, respectively. As seen in FIG. 1, stationary, arcuate guide plates 68 are positioned at the outboard sides of the other turnaround sections 18, as well as at the 90° turns of the conveyor 14 about sprockets 32 and 44, to preclude release of the rounds as the carriers open during transit therethrough.

It will be appreciated that the heights of the carrier half sides 52 are established such that the carriers can cradle the ammunition rounds on both sides in clamshall fashion during transit of the straight line sections 16 and sufficiently open up on the outboard side during transit of the turnaround sections to release the rounds without the inboard sides closing into interference with each other.

As best seen in FIG. 4, the midsections 50 of the carrier halves are apertured, as indicated at 50*a*, to remove weight without sacrificing requisite structural rigidity. The carrier half sides 52 are notched, as indicated at 52*a*, to provide clearance for the accelerating and decelerating sprockets of transfer stations 24 and 26. Also the edges of the carrier half sides are turned outwardly, as indicated at 52*b*, to facilitate round handoffs into and out of the carriers in turnaround sections 18*a* and 18*b*.

Figure 5:
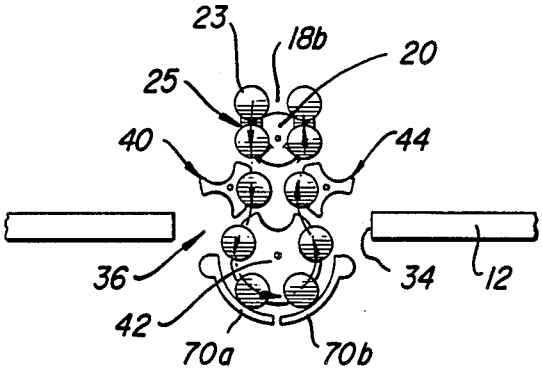
FIG. 5 is a side elevational view of one of the ammunition round transfer stations included in the ammunition conveying system of FIG. 1 shown in its bypass condition.

In the enlarged view of FIG. 5, transfer station 36 of FIG. 1 at magazine loading transfer port 34 is shown in its bypass condition. An arcuate guide plate, formed as two movable sections 70*a* and 70*b*, is disposed in closely spaced, circumferentially conforming relation with the lower half of transfer sprocket 42. Thus, when conveyor 14 is driven to convey live rounds to gun feeding magazine transfer port 22 (FIG. 1), the carriers 25 entering turnaround section 18*b* at magazine transfer port 34 hand off their rounds to accelerating sprocket 40, which in turn hands them off to transfer sprocket 42. Since guide plate sections 70*a*, 70*b* are in their closed, bypass positions, the rounds are retained in the transfer sprocket notches for conveyance around to decelerating sprocket 44 which then hands them back to the carriers before they close and depart turnaround section 18*b*. It will be appreciated that the transfer station sprockets 40, 42 and 44 are, in practice, provided in pairs or sets of laterally spaced or opposed sprockets.

Figure 6:
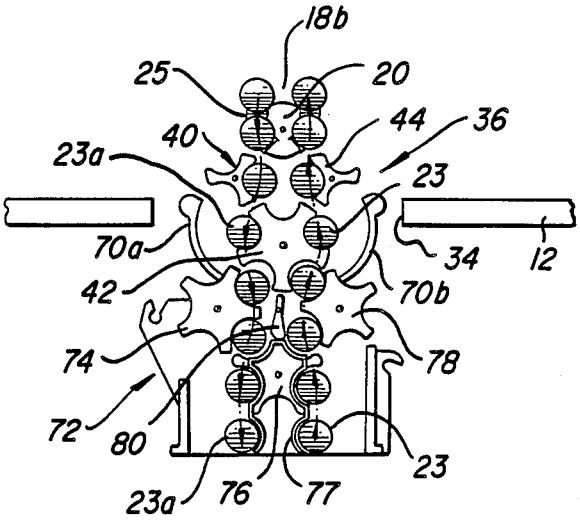
FIG. 6 is a side elevational view of the transfer station of FIG. 5, shown in its live round-spent case exchanging condition.

To reload the magazine with live ammunition rounds, suitable ammunition loading equipment, generally indicated at 72, is interfaced with magazine transfer port 34, as illustrated in FIG. 6. The interface end of this equipment includes a driven, unloading sprocket 74, a driven, turnaround sprocket 76 about which an ammunition loading conveyor 77 is trained, and a driven loading sprocket 78. With guide plate sections 70*a*, 70*b* shifted to their illustrated, opened, loading positions, carriers 25 entering turnaround section 18*b* open to hand off spent cases 23*a* to accelerating sprocket 40, which are handed off to transfer sprocket 42. The spent cases are guided by a diverter plate 80 from the transfer sprocket to unloading sprocket 74, from which they are handed off to successive carriers of a loading conveyor 77 for conveyance down into an ammunition loading container (not shown). At the same time, live ammunition rounds 23 are conveyed from this container by conveyor 77 up to turnaround conveyor sprocket 77 where they are picked off by diverter plate 80 and picked up by loading sprocket 78. From this loading sprocket, the live rounds are successively handed off to transfer sprocket 42 of transfer station 36, which then hands them off to decelerating sprocket 44 for deposit in the open carriers 25 of magazine conveyor 14. As these carriers leave turnaround section **18*b***, they close to assume cradled, positive retention of the live rounds just loaded thereinto.

While not disclosed, it will be appreciated that the portion of the gun feeding mechanism interfaced with magazine transfer port 22 is constructed in a manner analogous to the structure illustrated for ammunition loading equipment 72 to effect the live round-spent case exchanges with transfer station 24.

From the foregoing description, it is seen that the present invention provides an improved magazine ammunition conveying system wherein the ammunition rounds are positively retained in their individual carriers 25 throughout the major portion of the conveyor run within the magazine constituted by the straight line conveyor sections without resort to separator or guide plates heretofore stationed between adjacent straight line sections. The only locations requiring round-engaging guide plates are at the turnaround sections, which cumulatively represent a small percentage of the conveyor overall path length. Thus the frictional drag created by engagement of the rounds with stationary elements is minimized. Frictional drag is further reduced by utilizing the rolling engagement of the conveyor chain rollers 62 in trackways 66 to guide and control conveyor movement through the straight line sections so as to preclude interference between the segments of conveyor 14 running in opposite directions through adjacent, closely spaced straight line conveyor sections.

Moreover, the ammunition round carriers of conveyor 14 are of a light weight construction and are uniquely configured and mounted to the conveyor chains such that round handoffs to and from the individual carriers are effected without resort to special pickoff elements. That is, the individual carriers automatically open up long enough during transit of the turnaround sections to effect easy and reliable live round-spent case exchanges with any transfer stations located thereat.

It is thus seen that the objects set forth above, including those made apparent from the foregoing description, are efficiently attained, and, since certain changes may be made in the disclosed construction without departing from the present invention, it is intended that the details embodied therein be taken as illustrative and not in a limiting sense.

Having described the invention, what is claimed as new and desired to secure by Letters Patent is:

1. An article feeding system comprising, in combination:

A. a magazine including at least one article transfer port therein;

B. an endless article conveyor arranged within said magazine in a serpentine formation consisting of a plurality of straight line sections and interconnecting turnaround sections, one of said turnaround sections being located at said magazine transfer port, said conveyor including (1) a series of spaced turnaround sprockets about which said conveyor turnaround sections are trained, and (2) a succession of article carriers, each said carrier holding a single article and including a pair of opposed, pivotally interconnected carrier halves configured to assume closed, article retentive relative positions while in said straight line conveyor sections and opened, article releasing relative positions while in said conveyor turnaround sections;

C. an article transfer station located at said magazine transfer port, said transfer station including (1) first means operating to accelerate successive articles released by said carriers upon arrival at said one turnaround section from conveyor velocity to a transfer velocity, (2) transfer means for accepting accelerated articles from said first means, and (3) second means operating to decelerate successive articles accepted from said transfer means to conveyor velocity and individually deposit the decelerated articles in successive said carriers prior to departure from said one turnaround section; and D. guides positioned at the other said turnaround sections for precluding the release of the articles from said carriers during transit through said other turnaround sections.

2. A system defined in claim 1 wherein the articles are rounds of ammunition.

3. The system defined in claim 2, wherein said conveyor further includes laterally opposed chains, each including a succession of pivotally interconnected links, said carrier halves of each said carrier being respectively affixed at opposite ends to adjacent links of said opposed chains, the pivotal interconnections of said adjacent links located between said carrier halves, whereby pivotal articulation of said adjacent links during carrier transit through said turnaround sections causes said carrier halves to assume said opened relative positions.

4. The system defined in claim 3, wherein said conveyor further includes a series of rollers mounted at spaced intervals to said opposed chains, and opposed trackways mounted by said magazine in positions along said straight line sections for receiving said rollers.

5. The system defined in claim 4, wherein said opposed chains include pins pivotally interconnecting said adjacent links thereof, and said rollers being rotatably mounted on said pins, said turnaround sprockets engaging said rollers to train said conveyor chains through said turnaround sections.

6. The system defined in claim 2, wherein adjacent carrier halves of consecutive carriers are affixed together in back-to-back relation.

7. The system defined in claim 3, wherein adjacent carrier halves of consecutive carriers are commonly affixed at opposite ends respectively to one of said links of each said opposed chains.

8. The ammunition feeding system defined in claim 7, wherein each said carrier half is formed from sheet metal having a substantially planar midsection and a pair of opposed, round retentive sides offset therefrom, said midsections of said adjacent carrier halves being affixed together in juxtaposed, back-to-back relation.

9. The ammunition feeding system defined in claim 2, wherein said transfer station further includes ammunition guide means selectively positionable between open and closed positions, said guide means being located adjacent said transfer means and operating in said closed position to route rounds directly from said first means to said second means via said transfer means, said guide means in its open position enabling said transfer means to exchange rounds with ammunition handling equipment interfaced with said magazine transfer port.

10. The ammunition feeding system defined in claim 2, wherein said first means of said transfer station comprises a driven, round engaging, accelerating sprocket set, said transfer means comprises a driven, round engaging transfer sprocket set operable to exchange live rounds and spent cases with ammunition handling equipment interfaced with said magazine transfer port, and said second means comprises a driven, exchanged round engaging, decelerating sprocket set.

11. An ammunition feeding system comprising, in combination:

A. a magazine including first and second ammunition round transfer ports therein;

B. an endless, ladder-type ammunition conveyor arranged within said magazine in a serpentine formation consisting of a plurality of straight line sections and interconnecting, turnaround sections, a first one of said turnaround sections being located at said first magazine transfer port and a second one of said turnaround sections being located at said second magazine transport port, said conveyor including (1) a series of spaced turnaround sprockets about which said conveyor turnaround sections are trained, (2) a pair of opposed conveyor chains engaged by said turnaround sprockets, each said chain comprising a succession of links pivotally interconnected by pins, and (3) a succession of carriers, each capable of holding a single ammunition round and including a pair of opposed carrier halves respectively affixed at opposite ends to consecutive links of each of said opposed chains, said carrier halves of each said carrier pivotally assuming a closed, ammunition round retentive relative positions while in said straight line conveyor sections and pivotally assuming open, ammunition round releasing relative positions while in said conveyor turnaround sections;

C. an ammunition round transfer station located at each of said first and second magazine transfer ports, each said transfer station including (1) first means operating to accelerate successive ammunition rounds handed off by said carriers upon arrival at said first and second turnaround sections from conveyor velocity to a transfer velocity, (2) transfer means positioned to accept the handoffs of accelerated rounds from said first means for potential live round-spent round exchange with ammunition handling equipment interfaced with said first and second magazine transfer ports, and (3) third means operating to decelerate successive rounds handed off thereto by said transfer means to conveyor velocity and to individually deposit the decelerated rounds in successive said carriers prior to departure from said first and second turnaround sections; and D. guides positioned at the other of said turnaround sections for inhibiting handoffs of rounds from said carriers during transit through said other turnaround sections.

12. The ammunition feeding system defined in claim 11 wherein said opposed conveyor chains further include a roller rotatably mounted on each of said consecutive link pivotally interconnecting pins, and opposed trackways mounted by said magazine in positions along said straight line sections for receiving said rollers, said turnaround sprockets engaging said rollers to train said conveyor chains through said turnaround sections.

13. An ammunition feeding system defined in claim 12, wherein adjacent carrier halves of consecutive carriers are affixed in juxtaposed, back-to-back relation.

14. The ammunition of feeding system defined in claim 13, wherein each said carrier half is formed from sheet metal having a substantial planar midsection and a pair of opposed, ammunition round retentive sides offset therefrom.

15. The ammunition feeding system defined in claim 14, wherein one of said transfer stations further includes ammunition guide means selectively positionable between open and closed positions, said guide means being located adjacent said transfer means and operating in said closed position to route rounds directly from said first means to said second means via said transfer means, said guide means in said open position enabling said transfer means to exchange rounds with ammunition handling equipment interfaced with the one of said first and second magazine transfer ports thereat.

16. The ammunition feeding system defined in claim 14, wherein said first means of each said transfer station comprises a driven round engaging, accelerating sprocket set, said transfer means comprise a driven round engaging transfer sprocket set, and said third means comprises a driven, round engaging, decelerating sprocket set.

* * * * *